US007014097B1

(12) United States Patent
Gaillard et al.

(10) Patent No.: US 7,014,097 B1
(45) Date of Patent: Mar. 21, 2006

(54) MAILBOX MAIL-DELIVERED SIGNAL DEVICE KIT

(76) Inventors: Merrill J. Gaillard, 1247 Choupique Rd., Plaucheville, LA (US) 71362; Dorothea M. Gaillard, 1247 Choupique Rd., Plaucheville, LA (US) 71362

( * ) Notice: Subject to any disclaimer, the term of this patent is extended or adjusted under 35 U.S.C. 154(b) by 0 days.

(21) Appl. No.: 10/905,858

(22) Filed: Jan. 24, 2005

(51) Int. Cl.
*B65D 91/00* (2006.01)

(52) U.S. Cl. ..... 232/35

(58) Field of Classification Search ..... 232/35, 232/34, 17; 116/303, 215
See application file for complete search history.

(56) References Cited

U.S. PATENT DOCUMENTS

| | | | | | |
|---|---|---|---|---|---|
| 1,925,227 | A | * | 9/1933 | Black | 232/35 |
| 1,929,965 | A | * | 10/1933 | Black et al. | 232/35 |
| 2,815,167 | A | | 12/1957 | Bailes et al. | |
| 2,834,539 | A | * | 5/1958 | Carey | 232/35 |
| 2,988,268 | A | * | 6/1961 | Mioduski | 232/35 |
| 3,467,303 | A | * | 9/1969 | Saatzer | 232/35 |
| 3,572,581 | A | | 3/1971 | McLeod | |
| 3,958,752 | A | | 5/1976 | Pieszchala | |
| 3,968,928 | A | * | 7/1976 | Caldwell | 232/35 |
| 4,066,209 | A | | 1/1978 | Brake | |
| 4,150,780 | A | * | 4/1979 | Mapes | 232/35 |
| 4,186,870 | A | * | 2/1980 | Walden | 232/35 |
| 4,860,949 | A | | 8/1989 | Moore | |
| 5,004,148 | A | * | 4/1991 | Windrem | 232/35 |
| 5,092,517 | A | | 3/1992 | Jeffries, Jr. et al. | |
| D332,167 | S | | 12/1992 | Jackman | |
| 5,664,728 | A | | 9/1997 | Jones | |
| 5,769,312 | A | * | 6/1998 | Lampe | 232/35 |

* cited by examiner

*Primary Examiner*—William L. Miller
(74) *Attorney, Agent, or Firm*—Donald R. Schoonover

(57) ABSTRACT

A kit includes a reflector and a mount for pivotally mounting the reflector on a mailbox. A door mount element attaches the reflector to a door of a mailbox whereby the reflector is raised from a stored position to a signaling position when the door of the mailbox is opened.

1 Claim, 1 Drawing Sheet

MAILBOX MAIL-DELIVERED SIGNAL DEVICE KIT

BACKGROUND OF THE INVENTION

The present invention relates to the general art of signals, and to the particular field of signals associated with mailboxes.

Many people have their mailbox located some distance away from their home. This is especially so in rural areas where a mailbox may be located a great distance from the home in order to be readily accessible by a mailman.

This creates problems for many people. In inclement weather, a person may not want to trek all the way to a mailbox only to discover that the mail has not yet been delivered. A disabled person may not be able to easily move to a mailbox and does not want to make the trip to the mailbox unless he is sure the mail has been delivered.

Therefore, there is a need for a means for signaling when mail has been delivered to a mailbox.

The inventor is aware of many signaling mailboxes. However, the inventor is not aware of a mailbox signal kit that can be used to quickly and easily modify an existing mailbox to include a signaling feature.

Therefore, there is a need for a means for signaling when mail has been delivered to a mailbox, which means can be easily retrofit onto an existing mailbox.

Still further, some mailbox signals are not easily seen from a distance. A flag may be obscured on a cloudy day.

Therefore, there is a need for a means for signaling when mail has been delivered to a mailbox, which means can be easily retrofit onto an existing mailbox and which can be readily visible even in dim lighting conditions.

Some mail delivery signal systems are quite complex and some involve complex electronics. Such signal systems may be expensive to purchase and install and may require a significant amount of maintenance. These requirements may be drawbacks, especially in rural areas.

Therefore, there is a need for a simple and reliable means for signaling when mail has been delivered to a mailbox, which means can be easily retrofit onto an existing mailbox and which can be readily visible even in dim lighting conditions. PRINCIPAL OBJECTS OF THE INVENTION It is a main object of the present invention to provide a means for signaling when mail has been delivered to a mailbox.

It is another object of the present invention to provide a means for signaling when mail has been delivered to a mailbox, which means can be easily retrofit onto an existing mailbox.

It is another object of the present invention to provide a means for signaling when mail has been delivered to a mailbox, which means can be easily retrofit onto an existing mailbox and which can be readily visible even in dim lighting conditions.

It is another object of the present invention to provide a simple and reliable means for signaling when mail has been delivered to a mailbox, which means can be easily retrofit onto an existing mailbox and which can be readily visible even in dim lighting conditions.

SUMMARY OF THE INVENTION

These, and other, objects are achieved by a mailbox mail delivery signal kit which includes a mounting unit that is easily affixed to the door of a mailbox, a linkage rod connected at one end thereof to the mounting unit so the linkage rod moves with the door, a reflector unit which is pivotally mounted on the mailbox and which slidably accommodates the linkage rod. The linkage rod is slidably accommodated but will engage the reflector unit to move the reflector unit from a stored position to a signaling position when the door is opened. The slidable connection of the linkage rod causes the reflector unit to remain in the signaling position when the door is re-closed. The reflector unit includes a reflector element which is oriented to be easily visible even in dim lighting conditions.

The mailbox mail delivery signal kit embodying the present invention is easily installed on an existing mailbox and yet is easily used, maintained and will still have a readily visible signal that mail has arrived.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Referring to the Figures, it can be understood that the present invention is embodied in a mailbox mail delivery signal kit 10 that achieves the above-stated objectives.

Figure 2:
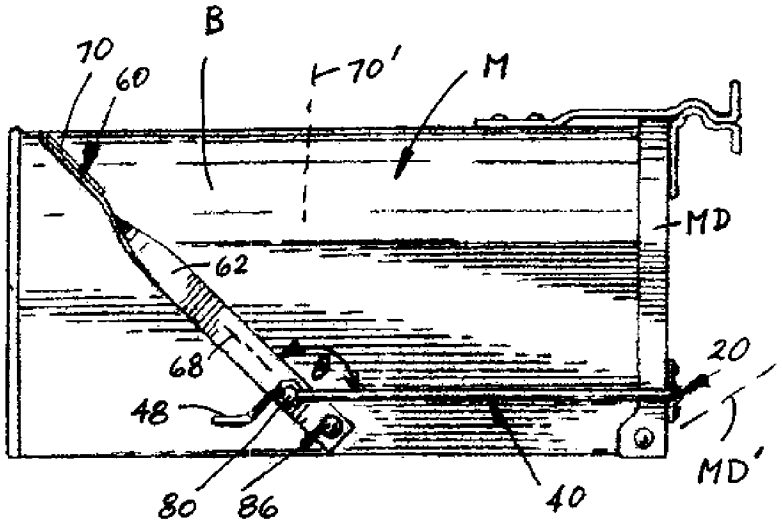
FIG. 2 is a side elevational view of a mailbox with the mailbox mail delivery kit installed thereon.
Figure 1:
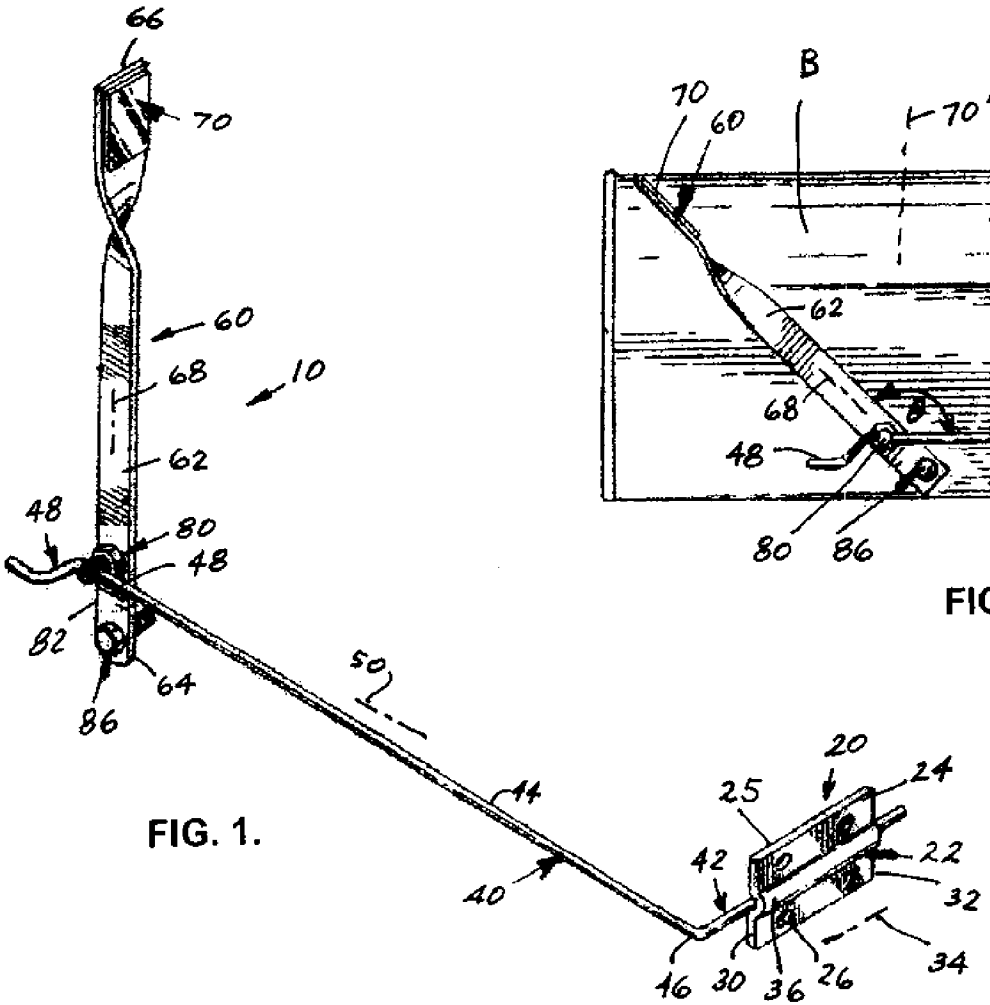
FIG. 1 is a perspective view of a mailbox mail delivery signal kit embodying the present invention.

Kit 10 is used in conjunction with a mailbox M which has a door MD which moves between a mailbox closed position shown in FIG. 2 and a mailbox open position MD' indicated by dotted lines in FIG. 2. Door MD is pivotally mounted on body B of mailbox M as is usual to such mailboxes.

Kit 10 comprises a mounting unit 20 which includes a mounting bracket 22 having a first surface 24 which is an outer surface when mounting unit 20 is mounted on a mailbox, a second surface 25 which is an inner surface when mounting unit 20 is mounted on a mailbox, and a plurality of fastener-receiving holes, such as hole 26, defined through mounting bracket 22. Bracket 22 further includes a first end 30, a second end 32, and a longitudinal axis 34 which extends between first end 30 and second end 32. A linkage rod-accommodating bore 36 is defined through mounting bracket 22 in the direction of longitudinal axis 34 from first end 30 to second end 32.

A plurality of fasteners, such as fastener 38, are each sized and adapted to be accommodated in one of the fastener-receiving holes 26 to mount mounting bracket 22 on a mailbox door whereby the mounting bracket 22 moves with the mailbox door.

A linkage rod 40 includes a mounting bracket-engaging end 42, which is pivotally received in linkage rod-accommodating bore 36 defined through the mounting bracket 22.

Rod 40 further includes a body 44 having a first end 46 unitary with mounting bracket-engaging end 42, a second end 48, and a longitudinal axis 50, which extends between first end 46 and second end 48.

Rod 40 further includes a distal end 54, which is unitary with second end 48 of body 44 and which is oriented at an oblique angle with respect to longitudinal axis 50.

A reflector unit 60 includes a base portion 62 having a first end 64 which is a proximal end when reflector unit 60 is mounted on a mailbox, a second end 66 which is a distal end when reflector unit 60 is mounted on a mailbox, and a longitudinal axis 68 which extends between first end 64 and second end 66.

A reflector element 70, such as a mirror or the like, is mounted on base portion 62 adjacent to second end 66. Reflector element 70 is oriented to reflect light in the direction of longitudinal axis 50 of body 44 of linkage rod 40.

A linkage rod-accommodating mount 80 is fixedly mounted on base portion 62 of reflector unit 60 adjacent to proximal end 64 and has a linkage rod-accommodating bore 82 defined therethrough. Linkage rod 40 is slidably accommodated in linkage rod-accommodating bore 82 when linkage rod 40 is mounted on a mailbox.

A pivot element 86 pivotally connects proximal end 64 of base portion 62 to a mailbox when reflector unit 60 is mounted on the mailbox. Linkage rod-accommodating mount 80 is located between pivot element 86 and reflector element 70 mounted on base portion 62.

Reflector unit 70 is movable between a stored position, shown in FIG. 2 in which base portion 62 of the reflector unit is oriented to have longitudinal axis 68 of the base portion 62 extend at an obtuse angle, θ, with respect to the direction of longitudinal axis 50 of body 44 of linkage rod 40 and a display position, indicated by dotted lines and reference indicator 70' in FIG. 2, in which reflector unit 70 is oriented to have longitudinal axis 68 of base portion 62 extend perpendicularly to longitudinal axis 50 of body 44 of linkage rod 40. The reflector unit 60 is moved from the stored position into the display position when the door of the mailbox is moved from a closed position into an open position; linkage rod 40 slides through linkage rod-accommodating bore 82 defined through linkage rod-accommodating mount 80 when the door of the mailbox is moved from an open position into the closed position after the reflector unit 60 is in the display position. The reflector unit 60 is moved back into the stored position manually.

It is understood that while certain forms of the present invention have been illustrated and described herein, it is not to be limited to the specific forms or arrangements of parts described and shown.

What is claimed is:

1. A mailbox mail delivery signal kit comprising:

a) a mounting unit which includes (1) a mounting bracket having a first surface which is an outer surface when said mounting unit is mounted on a mailbox, a second surface which is an inner surface when said mounting unit is mounted on a mailbox, a plurality of fastener-receiving holes defined through the mounting bracket, a first end, a second end, a longitudinal axis which extends between the first end and the second end, and a linkage rod-accommodating bore defined through the mounting bracket in the direction of the longitudinal axis from the first end to the second end, and (2) a plurality of fasteners, each of which is sized and adapted to be accommodated in one of the fastener-receiving holes to mount the mounting bracket on a mailbox door whereby the mounting bracket moves with the mailbox door;

b) a linkage rod which includes (1) a mounting bracket engaging end which is pivotally received in the linkage rod-accommodating bore defined through the mounting bracket, (2) a body having a first end unitary with the mounting bracket engaging end, a second end and a longitudinal axis which extends between the first end of the body of said linkage rod and the second end of the body of said linkage rod, and (3) a distal end which is unitary with the second end of the body of said linkage rod and which is oriented at an oblique angle with respect to the longitudinal axis of the body of said linkage rod;

c) a reflector unit which includes (1) a base portion having a first end which is a proximal end when said reflector unit is mounted on a mailbox, a second end which is a distal end when said reflector unit is mounted on a mailbox, a longitudinal axis which extends between the first end of the base portion of said reflector unit and the second end of the base portion of said reflector unit, and (2) a reflector element mounted on the base portion adjacent to the second end of the base portion, the reflector element being oriented to reflect light in the direction of the longitudinal axis of the body of said linkage rod;

d) a linkage rod-accommodating mount fixedly mounted on the base portion of said reflector unit adjacent to the proximal end of the body of the base portion of said reflector unit and having a linkage rod-accommodating bore defined therethrough, said linkage rod being slidably accommodated in the linkage rod accommodating-bore defined through said linkage rod-accommodating mount when said linkage rod is mounted on a mailbox;

e) a pivot element pivotally connecting the proximal end of the base portion of said reflector element to a mailbox when said reflector unit is mounted on the mailbox, said linkage rod-accommodating mount being located between said pivot element and the reflector element mounted on the base portion of said reflector unit; and f) said reflector unit being movable between a stored position in which the base portion of said reflector unit is oriented to have the longitudinal axis of the base portion extend at an obtuse angle with respect to the longitudinal axis of the body of said linkage rod and a display position in which said reflector unit is oriented to have the longitudinal axis of the base portion extend perpendicular to the longitudinal axis of the body of said linkage rod, said reflector unit being moved from the stored position into the display position when the door of the mailbox is moved from a closed position into an open position and said linkage rod sliding through the linkage rod accommodating bore defined through said linkage rod-accommodating mount when the door of the mailbox is moved from an open position into the closed position after said reflector unit is in the display position.

* * * * *